US011464384B1

(12) United States Patent
Caycoya et al.

(10) Patent No.: US 11,464,384 B1
(45) Date of Patent: Oct. 11, 2022

(54) WATER SOLUABLE PACKAGE FOR A FLOOR CLEANER

(71) Applicant: Techtronic Cordless GP, Anderson, SC (US)

(72) Inventors: Ryan Caycoya, Charlotte, NC (US); Vernon D. Campbell, Cornelius, NC (US)

(73) Assignee: Techtronic Cordless GP, Anderson, SC (US)

( * ) Notice: Subject to any disclaimer, the term of this patent is extended or adjusted under 35 U.S.C. 154(b) by 0 days.

(21) Appl. No.: 17/710,576

(22) Filed: Mar. 31, 2022

(51) Int. Cl.
*A47L 11/40* (2006.01)
*B65D 85/808* (2006.01)
*A47L 11/30* (2006.01)

(52) U.S. Cl.
CPC ..... *A47L 11/4083* (2013.01); *A47L 11/30* (2013.01); *A47L 11/4016* (2013.01); *A47L 11/4088* (2013.01); *B65D 85/808* (2013.01)

(58) Field of Classification Search
CPC .. A47L 11/4083; A47L 11/30; A47L 11/4016; A47L 11/4088; B65D 85/808
See application file for complete search history.

(56) References Cited

U.S. PATENT DOCUMENTS 3,695,989 A 10/1972 Albert
4,119,604 A 10/1978 Wysong
4,481,326 A 11/1984 Sonenstein
4,544,693 A 10/1985 Surgant
D285,412 S 9/1986 Harwell, Jr.
4,747,976 A 5/1988 Yang et al.
4,806,261 A 2/1989 Ciallella et al.
5,224,601 A 7/1993 Gouge et al.
(Continued)

FOREIGN PATENT DOCUMENTS

AU 2002356417 B2 10/2008
AU 2012201719 A1 4/2012
(Continued)

OTHER PUBLICATIONS

Fizzion, "Fizzion Pet Stain and Odor Eliminator (6 Tablets, Original)," <https://www.amazon.com/Fizzion-Eliminator-Professional-Cleaning-Original/dp/B07HY186TK> web page accessed on Apr. 5, 2022.

*Primary Examiner* — David Redding
(74) *Attorney, Agent, or Firm* — Michael Best & Friedrich LLP

(57) ABSTRACT

A floor cleaner includes a handle, a body, a base movable over a surface to be cleaned, and a supply tank coupled to the body. The supply tank having an inlet opening defining an inlet opening width and a fluid disposed therein. A water soluble package includes a cleaning solution disposed therein and is inserted within the supply tank to combine with the fluid disposed therein to form a cleaning fluid. A distribution nozzle is in communication with the supply tank and disperses the cleaning fluid towards a ground surface. The package has an unfolded dimension defined by a first width that is larger than the inlet width, a height defined orthogonal to the first width, and a thickness defined orthogonal to the first width and the height. The package folds from the unfolded dimension to a compact size having a folded dimension defined by a second width that is smaller than the inlet opening width.

20 Claims, 5 Drawing Sheets

(56) References Cited

U.S. PATENT DOCUMENTS 5,272,191 A 12/1993 Ibrahim et al.
5,384,364 A 1/1995 Besse et al.
6,037,319 A 3/2000 Dickler et al.
6,133,214 A 10/2000 Jung et al.
6,211,129 B1 4/2001 Gladfelter et al.
6,251,848 B1 6/2001 Holderbaum et al.
6,274,538 B1 8/2001 Addison
6,281,183 B1 8/2001 Harbour
6,455,484 B1 9/2002 Gladfelter et al.
6,624,130 B2 9/2003 Giblin et al.
6,686,329 B1 2/2004 Salager
6,727,215 B2 4/2004 Roberts et al.
6,730,647 B2 5/2004 Wäschenbach et al.
6,790,817 B2 9/2004 Gladfelter et al.
6,855,680 B2 2/2005 Smerznak et al.
6,878,679 B2 4/2005 Sommerville-Roberts et al.
6,995,126 B2 2/2006 Perkis et al.
7,169,740 B2 1/2007 Sommerville-Roberts et al.
7,208,459 B2 4/2007 Sadlowski et al.
D546,185 S 7/2007 Bates et al.
7,259,134 B2 8/2007 Beckholt et al.
D555,485 S 11/2007 Bates et al.
D559,116 S 1/2008 Bates et al.
D575,151 S 8/2008 Smith et al.
7,446,084 B2 11/2008 Barthel et al.
7,517,846 B2 4/2009 Gladfelter et al.
7,543,707 B2 6/2009 Miler
7,578,114 B2 8/2009 Duffield
7,891,515 B2 2/2011 Bourgoin et al.
7,902,140 B1 3/2011 Hansen
7,968,510 B2 6/2011 Smets et al.
7,977,298 B2 7/2011 Joinson
D643,574 S 8/2011 Heidel et al.
8,042,318 B2 10/2011 Ayats et al.
8,066,818 B2 11/2011 Brooker et al.
D651,340 S 12/2011 Heidel et al.
8,093,202 B2 1/2012 Danziger et al.
8,097,579 B2 1/2012 Danziger et al.
D656,402 S 3/2012 Kopulos et al.
D659,902 S 5/2012 Mehdizadeh
D660,156 S 5/2012 Kopulos et al.
D660,168 S 5/2012 Kopulos et al.
D661,018 S 5/2012 Mehdizadeh
8,197,830 B2 6/2012 Helfman et al.
8,247,364 B2 8/2012 Sadlowski et al.
D666,913 S 9/2012 Kopulos et al.
D668,554 S 10/2012 Tsuchiya
8,276,756 B2 10/2012 Denome et al.
D673,049 S 12/2012 Kopulos et al.
D673,857 S 1/2013 Kopulos et al.
8,354,366 B2 1/2013 Denome et al.
8,367,598 B2 2/2013 Sadlowski et al.
D679,183 S 4/2013 Kopulos et al.
D679,862 S 4/2013 Sunder
D680,445 S 4/2013 Kopulos et al.
D680,867 S 4/2013 Kopulos et al.
8,486,679 B2 7/2013 Dicosimo et al.
8,492,325 B2 7/2013 Sadlowski et al.
8,501,447 B2 8/2013 Dicosimo et al.
D689,240 S 9/2013 Sunder
8,546,119 B2 10/2013 Dicosimo et al.
8,546,120 B2 10/2013 Dicosimo et al.
8,551,929 B2 10/2013 Graham et al.
8,557,556 B2 10/2013 Dicosimo et al.
8,628,844 B2 1/2014 Catalfamo
8,697,624 B2 4/2014 Denome et al.
8,703,668 B2 4/2014 Melville et al.
8,735,125 B2 5/2014 Dicosimo et al.
8,759,275 B2 6/2014 Smets et al.
8,785,171 B2 7/2014 Souter et al.
8,785,361 B2 7/2014 Sivik et al.
8,785,364 B2 7/2014 Sadlowski et al.
8,809,030 B2 8/2014 Dicosimo et al.
8,889,610 B2 11/2014 Labeque et al.
8,895,493 B2 11/2014 Labeque et al.
8,956,843 B2 2/2015 Dicosimo et al.
8,962,294 B2 2/2015 Dicosimo et al.
D728,157 S 4/2015 Sarb
D733,962 S 7/2015 Sunder
9,074,305 B2 7/2015 Glenn, Jr. et al.
9,120,997 B2 9/2015 Sadlowski et al.
9,133,329 B2 9/2015 Denome et al.
9,163,205 B2 10/2015 Sivik et al.
D744,162 S 11/2015 Sunder
9,175,250 B2 11/2015 Sivik et al.
9,249,380 B2 2/2016 Gordon et al.
9,284,544 B2 3/2016 Jackson et al.
D759,891 S 6/2016 Sarb
9,382,506 B2 7/2016 Catlin et al.
9,416,339 B2 8/2016 Bianchetti et al.
9,421,153 B2 8/2016 Sivik et al.
9,434,916 B2 9/2016 Catlin et al.
9,480,628 B2 11/2016 Sivik et al.
9,493,730 B2 11/2016 Meek et al.
D774,249 S 12/2016 McLenithan
D774,250 S 12/2016 McLenithan
D774,251 S 12/2016 McLenithan
9,540,601 B2 1/2017 Miracle et al.
9,545,364 B2 1/2017 Glenn, Jr. et al.
9,550,962 B2 1/2017 Labeque et al.
9,670,436 B2 6/2017 Jackson et al.
9,718,589 B2 8/2017 Kopulos et al.
9,719,059 B2 8/2017 Massey-Brooker et al.
9,744,695 B2 8/2017 Patel et al.
D796,736 S 9/2017 Burdeos Andreu
D797,991 S 9/2017 Johnson et al.
D800,964 S 10/2017 Zuckerman et al.
9,796,948 B2 10/2017 Shearouse et al.
9,801,830 B2 10/2017 Darcy et al.
9,896,646 B2 2/2018 Depoot et al.
D812,297 S 3/2018 Johnson et al.
D821,645 S 6/2018 Nelemans et al.
D821,646 S 6/2018 Johnson et al.
10,023,826 B2 7/2018 De Poortere et al.
10,045,915 B2 8/2018 Glenn, Jr. et al.
10,059,912 B2 8/2018 Cooley et al.
10,287,532 B2 5/2019 Krubasik et al.
10,449,163 B2 10/2019 Darcy et al.
10,517,836 B2 12/2019 Darcy et al.
10,526,570 B2 1/2020 Dreher et al.
10,550,381 B2 2/2020 Rasmussen et al.
10,563,151 B2 2/2020 Krubasik et al.
10,646,413 B2 5/2020 Sivik et al.
10,703,549 B2 7/2020 Hodgdon et al.
10,857,756 B2 12/2020 Pratt et al.
10,894,005 B2 1/2021 Sivik et al.
10,912,738 B2 2/2021 Darcy et al.
D929,653 S 8/2021 Kaye et al.
2004/0253434 A1 12/2004 Patel et al.
2004/0259757 A1 12/2004 Gladfelter et al.
2005/0202995 A1 9/2005 Waits et al.
2005/0202996 A1 9/2005 Waits et al.
2007/0147942 A1 6/2007 Sojka et al.
2009/0176683 A1 7/2009 Choe et al.
2009/0196897 A1 8/2009 Gladfelter et al.
2010/0125046 A1 5/2010 Denome et al.
2012/0021026 A1 1/2012 Glenn, Jr. et al.
2012/0027838 A1 2/2012 Gordon et al.
2012/0052036 A1 3/2012 Glenn, Jr. et al.
2012/0058166 A1 3/2012 Glenn, Jr. et al.
2012/0172831 A1 7/2012 Darcy et al.
2012/0237576 A1 9/2012 Gordon et al.
2013/0102665 A1 4/2013 Dicosimo et al.
2013/0284637 A1 10/2013 Chou et al.
2014/0315776 A1 10/2014 Krubasik et al.
2014/0323383 A1 10/2014 Trujillo et al.
2014/0329428 A1 11/2014 Glenn, Jr. et al.
2015/0274413 A1 10/2015 Brandt Sanz et al.
2015/0275153 A1 10/2015 Murphy
2015/0336691 A1 11/2015 Fowler et al.
2015/0376556 A1 12/2015 Ohtani et al.
2016/0010041 A1 1/2016 Sivik et al.
2016/0068285 A1 3/2016 Fowler et al.
2016/0097022 A1 4/2016 Mikkelsen

(56) References Cited

U.S. PATENT DOCUMENTS

| | | | |
|---|---|---|---|
| 2016/0101204 | A1 | 4/2016 | Lynch et al. |
| 2016/0208202 | A1 | 7/2016 | Himmrich et al. |
| 2016/0215242 | A1 | 7/2016 | Himmrich et al. |
| 2016/0215243 | A1 | 7/2016 | Himmrich et al. |
| 2016/0222330 | A1 | 8/2016 | Letzelter et al. |
| 2016/0340068 | A1 | 11/2016 | Brandt Sanz |
| 2016/0347521 | A1 | 12/2016 | Fowler et al. |
| 2017/0029750 | A1 | 2/2017 | Letzelter et al. |
| 2017/0175059 | A1 | 6/2017 | Depoot et al. |
| 2017/0283749 | A1 | 10/2017 | Brandt Sanz et al. |
| 2018/0015643 | A1 | 1/2018 | Patel et al. |
| 2018/0148670 | A1 | 5/2018 | O'connell et al. |
| 2018/0290774 | A1 | 10/2018 | Fowler et al. |
| 2018/0338890 | A1 | 11/2018 | Glenn, Jr. et al. |
| 2019/0211289 | A1 | 7/2019 | Friedrich et al. |
| 2019/0233781 | A1 | 8/2019 | Huang et al. |
| 2019/0390138 | A1 | 12/2019 | Sivik et al. |
| 2020/0002646 | A1 | 1/2020 | Huang et al. |
| 2020/0102524 | A1 | 4/2020 | Dreher et al. |
| 2020/0109355 | A1 | 4/2020 | Herbst et al. |
| 2020/0109389 | A1 | 4/2020 | Rasmussen et al. |
| 2020/0157474 | A1 | 5/2020 | Degering et al. |
| 2020/0181543 | A1 | 6/2020 | Smets et al. |
| 2020/0190433 | A1 | 6/2020 | Nyangiro et al. |
| 2020/0190446 | A1 | 6/2020 | Sivik et al. |
| 2020/0261326 | A1 | 8/2020 | Sivik et al. |
| 2020/0270038 | A1 | 8/2020 | Hodgdon et al. |
| 2020/0283705 | A1 | 9/2020 | Smets et al. |

FOREIGN PATENT DOCUMENTS

| | | | | |
|---|---|---|---|---|
| AU | 2016200888 | A1 | | 3/2016 |
| CA | 2781484 | A1 | | 5/2011 |
| CA | 2876991 | A1 | | 12/2013 |
| CN | 305762288 | S | | 5/2020 |
| CN | 305762293 | S | | 5/2020 |
| CN | 305769427 | S | | 5/2020 |
| CN | 306025036 | S | | 9/2020 |
| CN | 306651555 | S | | 6/2021 |
| CN | 306910507 | S | | 10/2021 |
| EM | 003416536-0003 | | | 10/2016 |
| EM | 003416536-0004 | | | 10/2016 |
| EP | 2567898 | B1 | | 7/2015 |
| EP | 3025969 | A1 | | 6/2016 |
| EP | 2617659 | B2 | | 11/2020 |
| GB | 2456207 | A | * | 7/2009 |
| GB | 2513199 | B | | 4/2015 |
| GB | 2520306 | B | | 10/2015 |
| WO | 2007007031 | A1 | | 1/2007 |
| WO | 2015171091 | A1 | | 11/2015 |
| WO | WO2019139571 | A1 | * | 7/2019 |
| WO | 2020035567 | A1 | | 2/2020 |
| WO | 2020088957 | A1 | | 5/2020 |
| WO | 2020127775 | A1 | | 6/2020 |
| WO | 2020210893 | A1 | | 10/2020 |

* cited by examiner

WATER SOLUABLE PACKAGE FOR A FLOOR CLEANER

BACKGROUND

The present invention relates to water soluble packages for a floor cleaner.

SUMMARY

In one embodiment the invention provides a floor cleaner comprising a handle, a body coupled to the handle, a base coupled to the handle and movable over a surface to be cleaned, a supply tank having an inlet opening defining an inlet opening width, the supply tank configured to store a fluid, a water soluble package having a cleaning solution, the water soluble package configured to be inserted within the supply tank and combine with the fluid stored in the supply tank to form a cleaning fluid, and a distribution nozzle in communication with the supply tank, the distribution nozzle configured to disperse the cleaning fluid toward a surface. Wherein the water soluble package has an unfolded dimension defined by a first width that is larger than the inlet width, a height defined orthogonal to the first width, and a thickness defined orthogonal to the first width and the height. Wherein the water soluble package folds from the unfolded dimension to a compact size having a folded dimension defined by a second width that is smaller than the inlet opening width.

In another embodiment the invention provides a method of using a water soluble package in a floor cleaner including a supply tank having an inlet opening defining an inlet opening width, the supply tank configured to store a fluid. The method comprising providing the water soluble package having a cleaning solution, the water soluble package having an unfolded dimension defined by a first width that is larger than the inlet width, a height defined orthogonal to the first width, and a thickness defined orthogonal to the first width and the height, folding the water soluble package from the unfolded dimension to a compact size having a folded dimension defined by a second width that is smaller than the inlet opening width, and inserting the water soluble package through the inlet opening to combine the water soluble package with the fluid stored in the supply tank to form a cleaning fluid.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
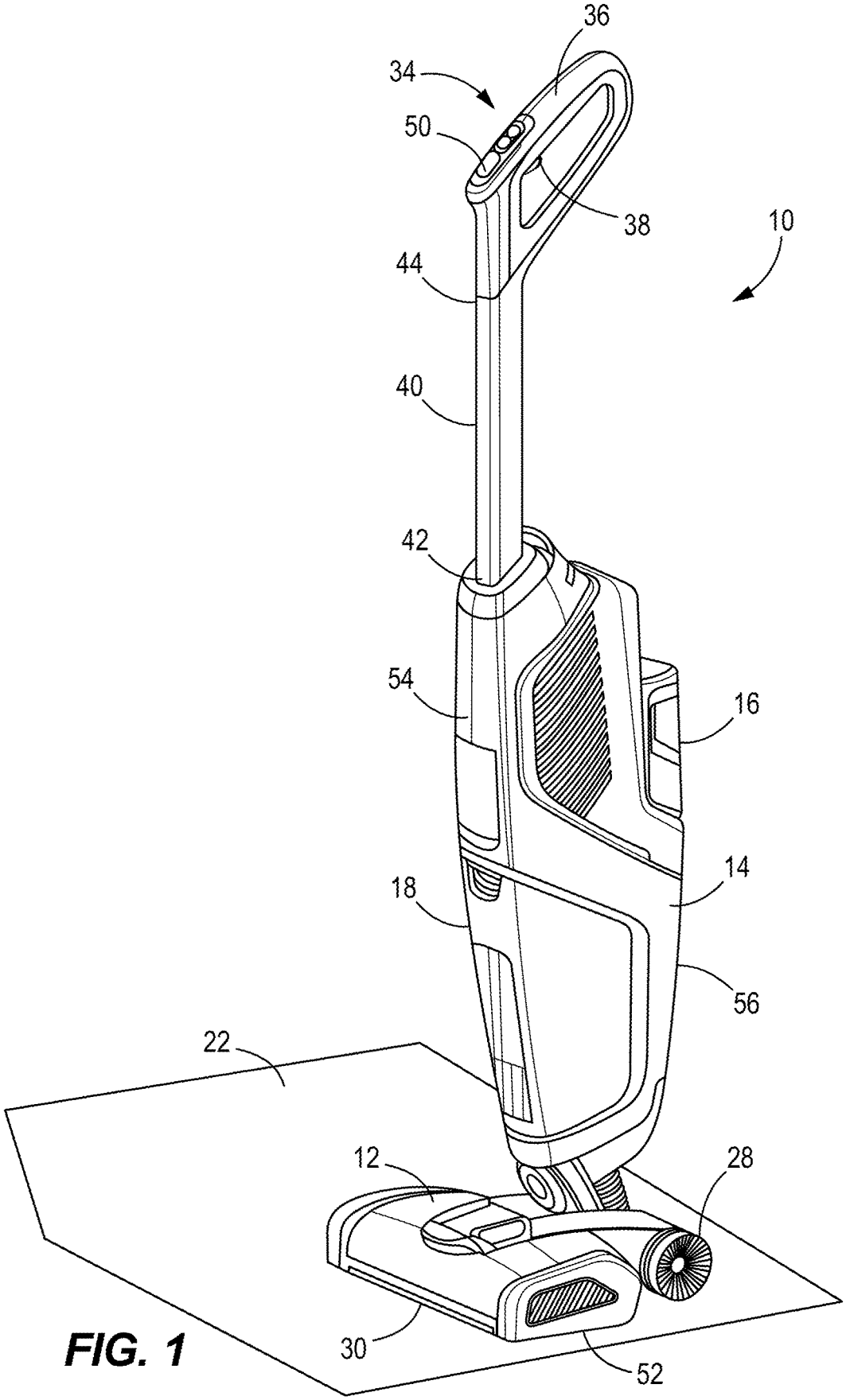
FIG. 1 is a perspective view of a floor cleaner according to one embodiment.

FIG. 1 illustrates a floor cleaner 10. In the illustrated embodiment, the floor cleaner 10 includes a base 12 and a body 14 pivotally coupled to the base 12. The body 14 is pivotal relative to the base 12 between an upright storage position and an inclined operating position. The floor cleaner 10 further includes a supply tank 16, a recovery tank 18, and a vacuum source 20. The supply tank 16 is configured to store a cleaning fluid and the floor cleaner 10 is operable to dispense the cleaning fluid onto a surface 22 to be cleaned.

Figure 2:
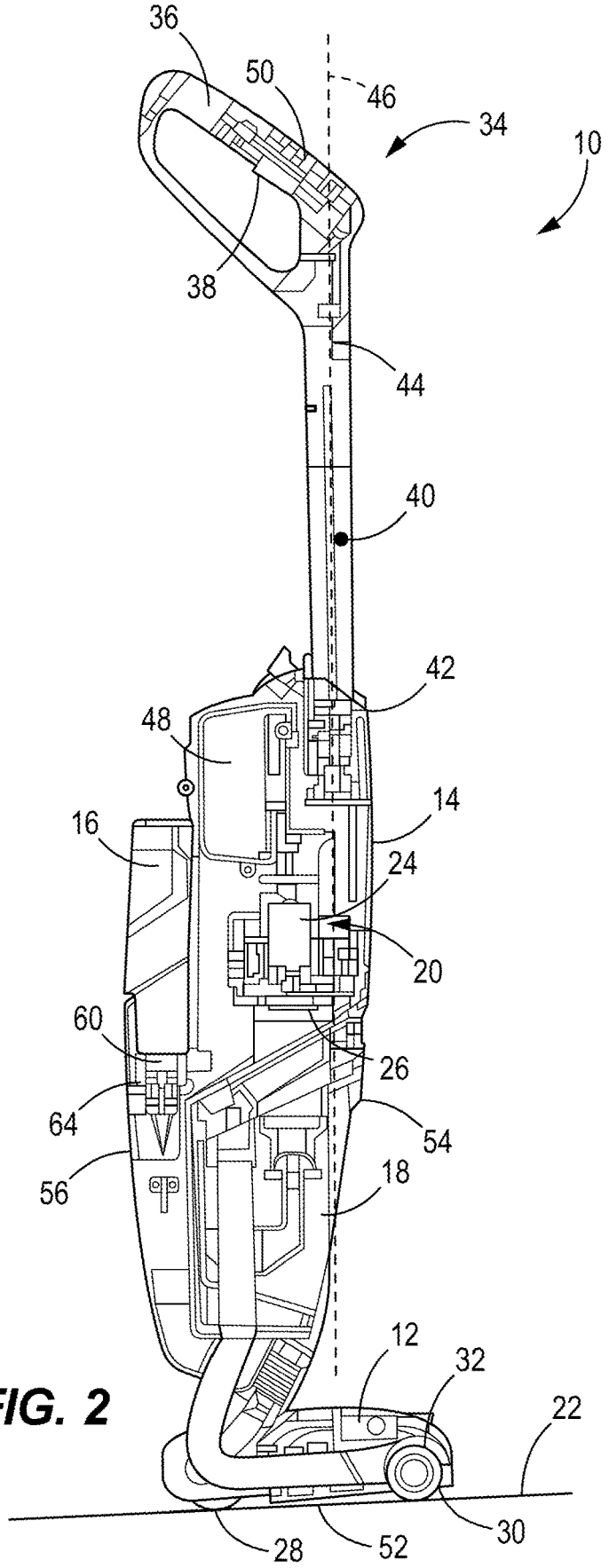
FIG. 2 is a side cross-sectional view of the floor cleaner of FIG. 1.

Referring to FIG. 2, the vacuum source 20 includes a motor 24 and a fan 26. The motor 24 and the fan 26 are operable to draw the cleaning fluid from the surface 22 into the recovery tank 18. The base 12 is movable over the surface 22 to be cleaned. In the illustrated embodiment, the base 12 includes wheels 28 to facilitate moving the base 12 over the surface 22. The base 12 includes a suction inlet 30 in fluid communication with the vacuum source 20 and the recovery tank 18. The cleaning fluid is drawn from the surface 22 through the suction inlet 30 and into the recovery tank 18. The base 12 further includes a distribution nozzle 32 in fluid communication with the supply tank 16. The distribution nozzle 32 dispenses the cleaning fluid toward the surface 22.

The floor cleaner 10 further includes a handle 34. The handle 34 includes a grip 36 and an actuator 38 adjacent the grip 36. The grip 36 is grabbed by the user to move the floor cleaner 10 along the surface 22 and to pivot the body 14 relative to the base 12. The actuator 38 controls the flow of cleaning fluid from the supply tank 16 through the distribution nozzle 32. The handle 34 further includes an extension 40 that extends from the body 14. The extension 40 includes a first end 42, a second end 44, and a handle axis 46 that extends centrally through the first end 42 and the second end 44 as illustrated in FIG. 2. The first end 42 is coupled to and adjacent the body 14. The second end 44 is adjacent the grip 36. The floor cleaner 10 further includes a battery 48 (FIG. 2) that provides power to the vacuum source 20. The battery 48 is a rechargeable lithium-ion battery in one embodiment.

Referring to FIGS. 1 and 2, the floor cleaner 10 further includes an upper end 50 and a lower end 52 opposite the upper end 50. The handle 34 is adjacent the upper end 50 and the base 12 is adjacent the lower end 52. The floor cleaner 10 further include a front side 54 and a back side 56 opposite the front side 54. The suction inlet 30 is adjacent the front side 54. In the illustrated embodiment, the supply tank 16 is coupled to the front side 54 and the recovery tank 18 is coupled to the back side 56 of the body 14. In other embodiments, the supply tank 16 and the recovery tank 18 may be coupled to the base 22 or the handle 34.

Figure 5:
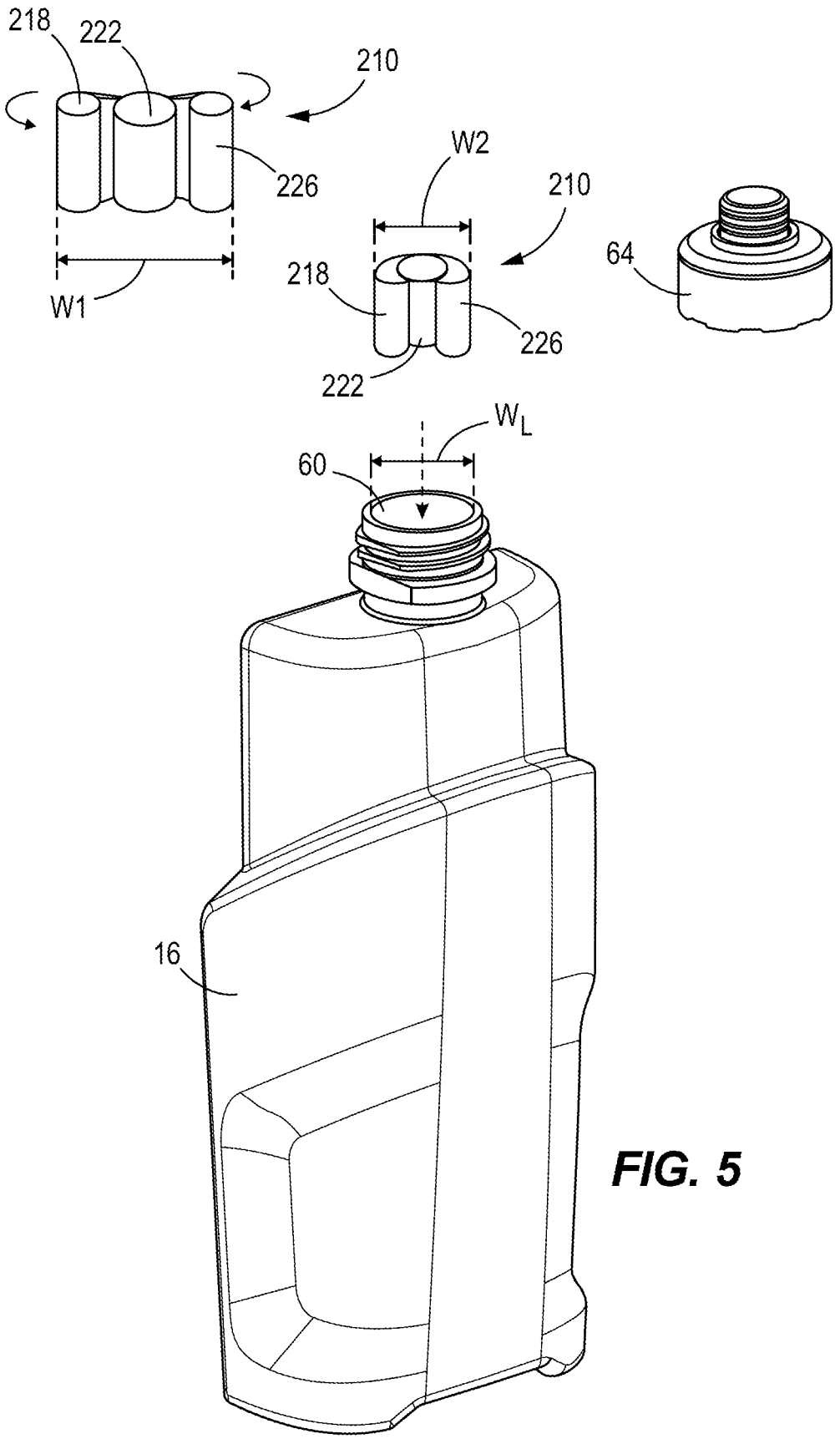
FIG. 5 is a perspective exploded view of a supply tank of the floor cleaner of FIG. 1, illustrating the water soluble package of FIG. 4 being inserted within an inlet opening of the supply tank.

Referring to FIGS. 2 and 5, the supply tank 16 includes an inlet opening 60 defining an inlet opening width WL and a cap 64 (FIG. 5) removably coupled to the supply tank 16 (e.g., threadably coupled) to selectively enclose the inlet opening 60. In the illustrated embodiment, the inlet opening 60 is circular and the inlet opening width WL is the diameter of the inlet opening 60. The inlet opening width WL may be in a range from 20 mm to 50 mm. In some embodiments, the inlet opening WL may be greater than 50 mm. In other embodiments, the inlet opening 60 may have an alternative geometry (rectangular, triangular, etc.).

Figure 3:
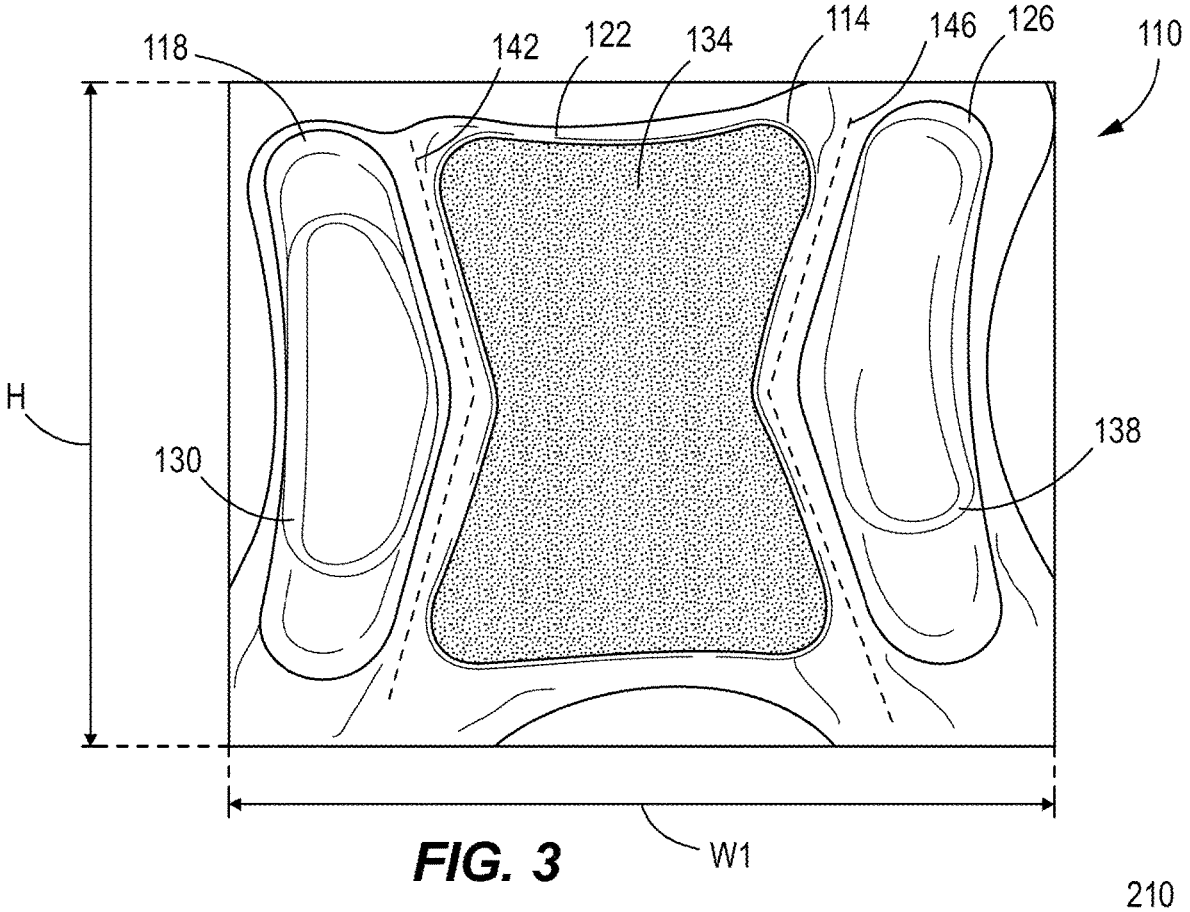
FIG. 3 is a front view of a water soluble package according to one embodiment.

FIG. 3 illustrates a water soluble package 110 according to an embodiment. The water soluble package 110 includes a film 114 defining compartments 118, 122, 126 that house cleaning solutions 130, 134, 138. The film 114 defines a first compartment 118 having a first cleaning solution 130, a second compartment 122 having a second cleaning solution 134, and a third compartment 126 having a third cleaning solution 138. In other embodiments, the film 114 may define more (e.g. four, five, etc.) or less (e.g., two) compartments.

In one embodiment, the second cleaning solution 134 is different than the first cleaning solution 130 and the third solution 138 is the same as the first cleaning solution 130. In other embodiments, the third cleaning solution may be different than the first and second cleaning solutions 130, 134. Further, the first cleaning solution 130 includes a liquid ingredient and the second cleaning solution 134 includes a powder ingredient. The powder ingredient includes one or more of a surfactant, a PH adjuster, and a preservative. The liquid ingredient includes one or more of a surfactant and a fragrance. In the illustrated embodiment, the ratio of liquid ingredient to powder ingredient is 1-1. In other embodiments, the ratio may be 2-1, 1-2, 3-1, or 1-3. The water soluble package 110 may weigh 10 grams in some embodiments.

With continued reference to FIG. 3, the first compartment 118 and the third compartment 126 have a first geometry and the second compartment 122 has a second geometry that is different than the first geometry. In the illustrated embodiment, the first geometry is generally triangular and the second geometry is a wishbone shape. In other embodiments, the first and second geometries may have an alternative construction (e.g., cylindrical, rectangular, or the like)

The water soluble package 110 has an unfolded dimension defined by a first width W1 that is larger than the inlet width WL, a height H defined orthogonal to the first width W1, and a thickness (e.g., into the page with reference to FIG. 3) defined orthogonal to the first width W1 and the height H. The film 114 of the water soluble package 110 further includes a first fold line 142 positioned between the first compartment 118 and second compartment 122 and a second fold line 146 positioned between the second compartment 122 and the third compartment 126. As described in more detail below, the water soluble package 110 folds from the unfolded dimension (FIG. 3) to a compact size having a folded dimension defined by a second width that is smaller than the inlet opening width WL. For example, the first compartment 118 may be folded relative to the second compartment 122 about the first fold line 142 and the third compartment 126 may be folded relative to the second compartment 122 about the second fold line 146. In the folded dimension, the water soluble package 110 may be inserted within the supply tank 16 and combine with the fluid stored in the supply tank 16 to form a cleaning fluid.

Figure 4:
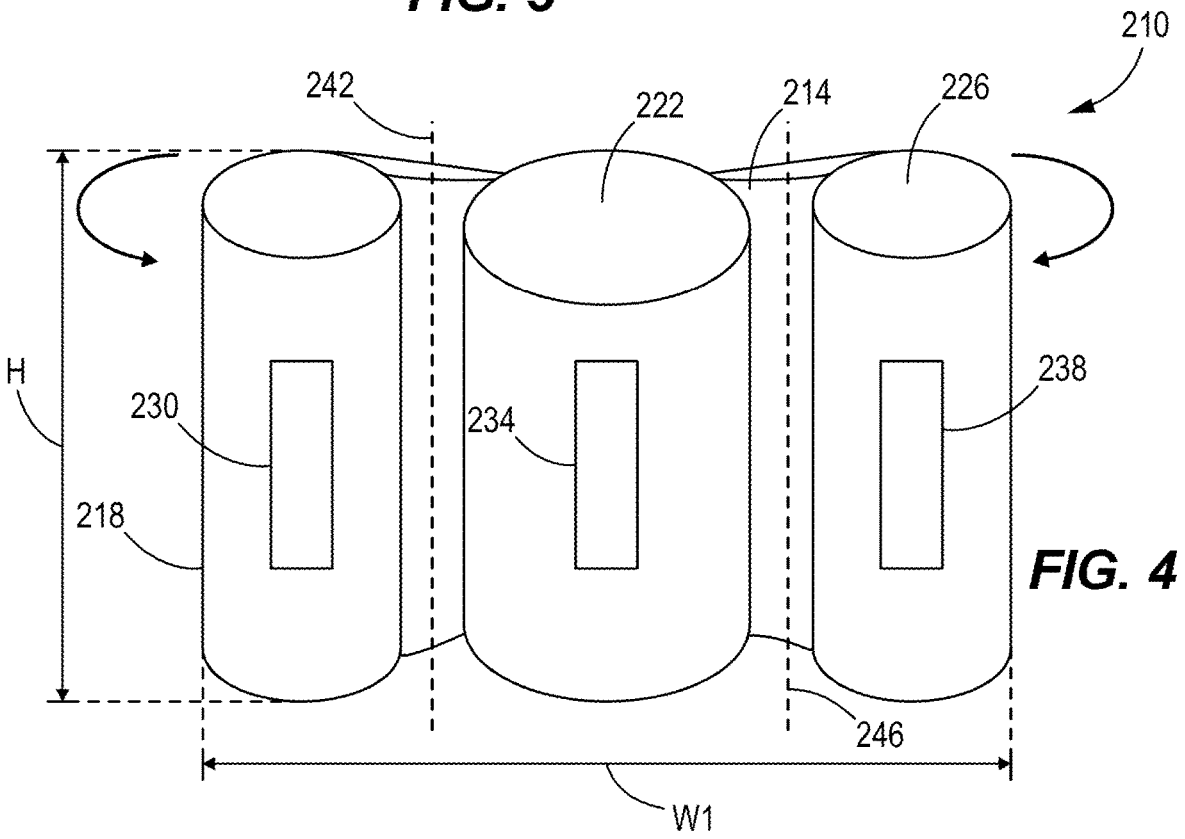
FIG. 4 is a perspective view of a water soluble package according to another embodiment.

FIG. 4 illustrates a water soluble package 210 according to another embodiment of the invention. The water soluble package 210 is like the water soluble package 110 shown in FIG. 3 and described above. Therefore, like features are identified with like reference numerals plus "100", and only the differences between the two will be discussed. It should also be appreciated that the water soluble package 110 may be inserted within the supply tank 16 in a similar fashion as the water soluble package 210.

The water soluble package 210 includes a film 214 defining a first compartment 218 having a first cleaning solution 230, a second compartment 222 having a second cleaning solution 234, and a third compartment 226 having a third cleaning solution 238. In the illustrated embodiment, each compartment 218, 222, 226 includes a cylindrical construction. In particular, the first compartment 218 and the third compartment 226 have a first diameter and the second compartment has a second diameter that is greater than the first diameter. As such, the first compartment 218 and the third compartment 226 have a first geometry and the second compartment 222 has a second geometry that is different than the first geometry.

The water soluble package 210 has an unfolded dimension defined by a first width W1 that is larger than the inlet width WL, a height H defined orthogonal to the first width W1, and a thickness (e.g., into the page with reference to FIG. 4) defined orthogonal to the first width W1 and the height H. The film 214 of the water soluble package 210 further includes a first fold line 242 positioned between the first compartment 218 and the second compartments 222 and a second fold line 246 positioned between the second compartment 222 and the third compartment.

With reference to FIGS. 4 and 5, the water soluble package 210 folds from the unfolded dimension (FIG. 4) to a compact size (FIG. 5) having a folded dimension defined by a second width W2 that is smaller than the inlet opening width WL. For example, the first compartment 218 is folded relative to the second compartment 222 about the first fold line 242 (FIG. 4) and the third compartment 226 is folded relative to the second compartment 222 about the second fold line 246 (FIG. 4). In the illustrated embodiment, the first and third compartments 218, 226 are folded in the same direction onto the second compartment 222. In the folded dimension, the water soluble package 210 is inserted within the supply tank 16 and combines with the fluid stored in the supply tank 16 to form a cleaning fluid.

Figure 6:
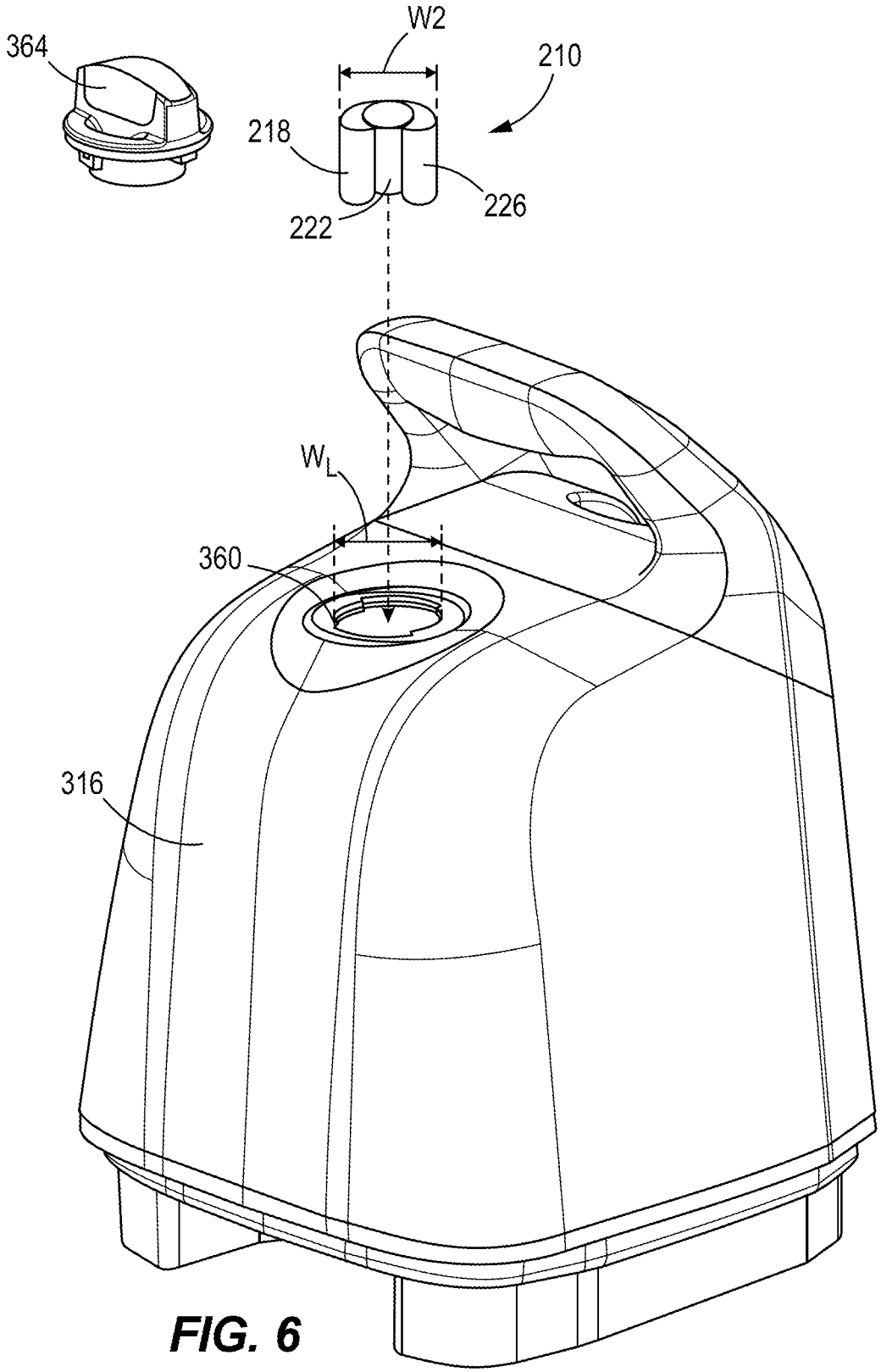
FIG. 6 is a perspective exploded view of a supply tank according to another embodiment, illustrating the water soluble package of FIG. 4 being inserted within an inlet opening of the supply tank.

FIG. 6 illustrates a supply tank 316 according to another embodiment. The supply tank 316 may be coupled to a floor cleaner such as an extractor. Similar to the supply tank 16, the supply tank 316 includes an inlet opening 360 and a cap removably coupled to the supply tank to selectively enclose the inlet opening 360. In the folded dimension the water soluble package 110 or the water soluble package 210 may be inserted within the inlet opening 360.

Various features and advantages of the invention are set forth in the following claims.

What is claimed is:

1. A floor cleaner comprising:

a handle;

a body coupled to the handle;

a base coupled to the handle and movable over a surface to be cleaned;

a supply tank having an inlet opening defining an inlet opening width, the supply tank configured to store a fluid;

a water soluble package having a cleaning solution, the water soluble package configured to be inserted within the supply tank and combine with the fluid stored in the supply tank to form a cleaning fluid; and a distribution nozzle in communication with the supply tank, the distribution nozzle configured to disperse the cleaning fluid toward a surface;

wherein the water soluble package has an unfolded dimension defined by a first width that is larger than the inlet width, a height defined orthogonal to the first width, and a thickness defined orthogonal to the first width and the height, wherein the water soluble package folds from the unfolded dimension to a compact size having a folded dimension defined by a second width that is smaller than the inlet opening width.

2. The floor cleaner of claim 1, wherein the inlet opening width is in a range from 20 mm to 50 mm.

3. The floor cleaner of claim 1, wherein the inlet opening width is greater than 50 mm.

4. The floor cleaner of claim 1, wherein the inlet opening is circular, and wherein the inlet opening width is a diameter of the inlet opening.

5. The floor cleaner of claim 1, wherein the water soluble package includes a film defining a first compartment having a first cleaning solution and a second compartment having a second cleaning solution that is different than the first cleaning solution.

6. The floor cleaner of claim 5, wherein the water soluble package includes a first fold line positioned between the first and second compartments.

7. The floor cleaner of claim 5, wherein the first cleaning solution includes a liquid ingredient and the second cleaning solution includes a powder ingredient.

8. The floor cleaner of claim 7, wherein the powder ingredient includes one or more of a surfactant, a PH adjuster, and a preservative.

9. The floor cleaner of claim 7, wherein the liquid ingredient includes one or more of a surfactant and a fragrance.

10. The floor cleaner of claim 5, wherein the water soluble package includes a third compartment having a third cleaning solution.

11. The floor cleaner of claim 10, wherein the first and the third compartments have a first geometry and the second compartment have a second geometry that is different than the first geometry.

12. The floor cleaner of claim 10, wherein the third cleaning solution is the same as either the first cleaning solution or the second cleaning solution.

13. The floor cleaner of claim 10, wherein the water soluble package includes a first fold line positioned between the first and second compartments and a second fold line positioned between the second compartment and the third compartment.

14. The floor cleaner of claim 10, wherein the second compartment is positioned between the first and third compartments.

15. The floor cleaner of claim 1, further comprising a vacuum source within the body, a suction inlet formed in the base and in fluid communication with the vacuum source, and a recovery tank coupled to the body, the recovery tank configured to store the cleaning solution drawn through the suction inlet from the surface by the vacuum source.

16. A method of using a water soluble package in a floor cleaner including a supply tank having an inlet opening defining an inlet opening width, the supply tank configured to store a fluid, the method comprising:

providing the water soluble package having a cleaning solution, the water soluble package having an unfolded dimension defined by a first width that is larger than the inlet width, a height defined orthogonal to the first width, and a thickness defined orthogonal to the first width and the height;

folding the water soluble package from the unfolded dimension to a compact size having a folded dimension defined by a second width that is smaller than the inlet opening width; and inserting the water soluble package through the inlet opening to combine the water soluble package with the fluid stored in the supply tank to form a cleaning fluid.

17. The method of claim 16, wherein folding the water soluble package includes folding a first compartment having a first cleaning solution relative to a second compartment having a second cleaning solution about a first fold line.

18. The method of claim 17, wherein folding the water soluble package includes folding a third compartment having a third cleaning solution relative to the second compartment about a second fold line.

19. The method of claim 18, further comprising forming the first compartment with a first geometry and forming the second and third compartments with a second geometry.

20. The method of claim 17, wherein folding the water soluble package includes folding the first and third compartments onto the second compartment.

* * * * *